US009393170B2

(12) United States Patent
Savage

(10) Patent No.: US 9,393,170 B2
(45) Date of Patent: Jul. 19, 2016

(54) FUNERARY ITEM WITH EMBEDDED CREMAINS AND EXTERNAL ETCHING

(71) Applicant: Nick Savage, Santa Barbara, CA (US)

(72) Inventor: Nick Savage, Santa Barbara, CA (US)

( * ) Notice: Subject to any disclaimer, the term of this patent is extended or adjusted under 35 U.S.C. 154(b) by 0 days.

(21) Appl. No.: 14/591,739

(22) Filed: Jan. 7, 2015

(65) Prior Publication Data

US 2015/0209211 A1 Jul. 30, 2015

Related U.S. Application Data

(60) Provisional application No. 61/924,611, filed on Jan. 7, 2014.

(51) Int. Cl.

| | |
|---|---|
| ***A61G 17/08*** | (2006.01) |
| ***A61G 99/00*** | (2006.01) |
| ***A44C 27/00*** | (2006.01) |
| *A44C 25/00* | (2006.01) |

(52) U.S. Cl.

CPC ..... *A61G 17/08* (2013.01); *A44C 27/00* (2013.01); *A61G 99/00* (2013.01); *A44C 25/002* (2013.01)

(58) Field of Classification Search

CPC ..... A61G 17/00; A61G 17/08; A61G 99/00; E04H 13/008; A47G 1/0616; A47G 33/00; B44C 5/0446; A44C 27/00; A44C 25/002

USPC ..... 27/1; 40/124.5, 722, 725; 428/542.4; 63/1.14

See application file for complete search history.

(56) References Cited

U.S. PATENT DOCUMENTS

| | | | | |
|---|---|---|---|---|
| 5,704,103 | A * | 1/1998 | Crowley et al. | 27/1 |
| 5,950,287 | A * | 9/1999 | Cacciatore et al. | 27/1 |
| 5,950,288 | A * | 9/1999 | Bach Lahor | 27/1 |
| 6,665,916 | B1 * | 12/2003 | Santorello et al. | 27/1 |
| 7,082,653 | B1 * | 8/2006 | Sueppel | 27/1 |
| 7,373,703 | B1 * | 5/2008 | Grenci | 27/1 |
| 7,793,393 | B2 * | 9/2010 | Roberts | 27/1 |
| 7,861,385 | B1 * | 1/2011 | Meyer | 27/1 |
| 7,934,298 | B1 * | 5/2011 | Ghazvini | 27/1 |
| 2002/0082855 | A1 * | 6/2002 | Dickey et al. | 705/1 |
| 2005/0005409 | A1 * | 1/2005 | Elnatan | 27/1 |
| 2005/0246877 | A1 * | 11/2005 | Davis et al. | 27/1 |
| 2006/0016053 | A1 * | 1/2006 | Desmond et al. | 27/1 |
| 2006/0207075 | A1 * | 9/2006 | Davis | 27/1 |
| 2010/0199476 | A1 * | 8/2010 | Cummings et al. | 27/1 |
| 2012/0091028 | A1 * | 4/2012 | Fuhrman | 206/568 |
| 2012/0180275 | A1 * | 7/2012 | Kocir | 27/1 |
| 2012/0317765 | A1 * | 12/2012 | Johnson | 27/1 |
| 2013/0117977 | A1 * | 5/2013 | Kennedy | 27/1 |

* cited by examiner

*Primary Examiner* — William Miller

(74) *Attorney, Agent, or Firm* — Steven W. Webb

(57) ABSTRACT

A novel method of displaying cremated remains of a human or animal decedent is presented, where a portion of decedent cremains is encased within a transparent device with an etched memento of the decedent on the outside of the device. The memento can be a human fingerprint or the nose print of an animal.

2 Claims, 2 Drawing Sheets

FUNERARY ITEM WITH EMBEDDED CREMAINS AND EXTERNAL ETCHING

RELATED APPLICATIONS

This application claims the benefit of U.S. Provisional Patent Application 61/924,611, filed Jan. 7, 2014, which is included here by reference.

FIELD OF THE INVENTION

Methods for holding the cremated remains of deceased living beings include various types of urns which receive the ashes of the dead. This patent application relates to the field of funerary urns, devices, and memorials.

BACKGROUND OF THE INVENTION

Receptacles for cremated remains include U.S. Pat. No. 232,782 as far back as 1880 and more recently U.S. Pat. Nos. 2,009,724, 2,562,726 and 3,167,844. Adding indicia or descriptors of the deceased to urns is covered in teachings such as U.S. Pat. No. 2,835,014 and U.S. Pat. No. 1,940,771, which shows a unique type of urn with descriptive material concerning the deceased and integrally formed with the funerary item.

Additionally, other types of memorial images and shaped objects are used to perpetuate the memory of loved ones. For example, the medallion in U.S. Pat. No. 4,222,189 includes an embossed or carved face surrounded by a decoration. Such an object may be cast or injection molded. More recently, U.S. Pat. Appl. 2012/0091028 teaches a chain-held "dogtag" with the embossed thumbprint of a decedent, and U.S. Pat. Appl. 2010/0199476 shows a clear glass sphere with cremains plus personal items inside. Finally, US Pat. Appl. U.S. 2013/0117977 teaches a solid glass item with embedded cremains.

SUMMARY OF THE INVENTION

The method of the present invention comprises cremating the expired remains of a living being to produce a resultant particulate ash product. A mixture of particulate moldable materials adapted for forming a molded object is prepared, in the preferred embodiment glass. The moldable product is then shaped to a rigid object consisting of a colored glass core.

Once having produced the resultant particulate ash product by cremating the remains of the deceased, all or a portion of that ash product is blended with the softened exterior of said colored glass core. A transparent glass outer layer is then applied to the exterior of said colored glass core to cover the resulting item in such a manner that the embedded cremains are easily visible. The shape of the moldable object and the shape of the transparent glass outer layer are arbitrary; typical shapes might be spheres, pear-shapes, cubes, or other fanciful geometric arrangements.

Finally, a fingerprint or other personal device of the decedent is inscribed by means of etching, in the preferred embodiment laser etching, on the outer surface of the transparent outer layer. Multiple copies of the inscription on the outside are possible Any type of shaping process may be used to form the colored inner core and transparent outer layer including various known manual glass-shaping operations. Mechanical means that preserve the layering with funerary ashes can be used, as long as the intent of the designer is maintained.

DETAILED DESCRIPTION OF THE INVENTION

Figure 1:
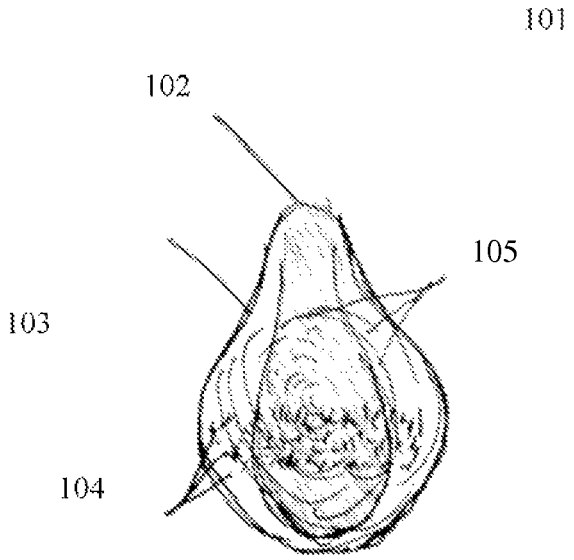
FIG. 1. Front view of the Invention, showing the layers of glass
Figure 2:
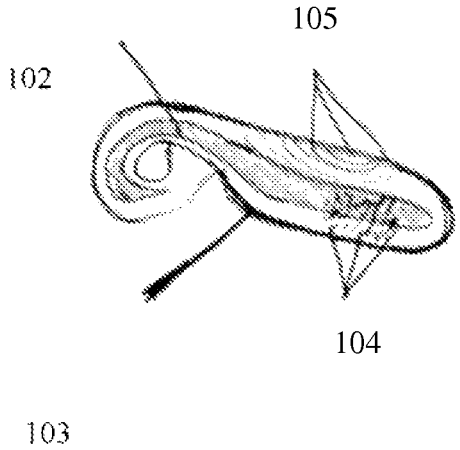
FIG. 2. Side view of the invention

The invention 101 is comprised of two layers of material, an interior layer 102 and a clear, outer layer 103. Sandwiched between these layers is a layer of human or animal cremated remains (cremains) 104. On the surface of the outer layer is one or more etched mementos 105 of the decedent, either a human finger print or a nose print or paw print of a deceased animal. The interior layer 102 is colored in one of a plurality of colors to provide contrast for exhibition of the cremains 104. It is also contemplated by this invention that multi-colored interior layers 102 are possible, with colors arranged in a pleasing or decorative pattern.

The method of manufacture of the invention 101 is to first decide on a shape for the invention 101, so that the interior layer 102 can be made. The preferred material for the interior layer 102 is glass. Once the interior layer 102 is cast, the cremains 104 are positioned around the interior layer 102 in a distinctive pattern, then the outer layer 103 is cast around the invention 101. It is expected that in most cases, the outer layer 103 is merely an encasing layer of transparent glass, but a separate shape different from the basic shape of the interior layer 102 is included in this invention.

Finally, the outer layer 103 is etched by physical means, the preferred method being laser etching. The outer layer etching is one or more mementos 105 of the decedent or deceased animal, and the pattern for said memento 105 is taken from a human fingerprint or an animal nose print/paw print. Other information, such as a name or epitaph can be etched as well.

While the foregoing describes a preferred mode of the invention, variation on this design and equivalent methods may be resorted to in the scope and spirit of the claimed invention.

What is claimed is:

1. A funerary item, the funerary item comprised of an interior layer and an outer layer, the interior layer colored in one or more of a plurality of colors, the outer layer either completely transparent or tinted with one or more of a plurality of colors such that said outer layer is translucent, the interior layer shaped in any of a plurality of decorative shapes, the outer layer shaped in any of a plurality of decorative shapes, the outer layer surrounding said interior layer with an even thickness, said interior and outer layers comprised of a hard material selected from glass, plastic, or transparent ceramic, the interior and outer layer possessing a separate layer of decedent human or animal cremated remains sandwiched between them, said layer of cremated remains in an arbitrary shape or simply scattered, the surface of the outer layer possessing one or more etched mementos of the decedent, said one or more etched mementos being a human finger print or a nose print or paw print of a deceased animal, the means of etching said mementos selected from laser, chemical, or physical etching.

2. A method of producing the funerary item as in claim 1, comprised of the steps of selecting the material to use for the interior layer of the funerary item, shaping the interior layer of the funerary item by means of casting or machining, placing the separate layer of decedent human or animal cremated remains on the outside of the interior layer of the funerary item, selecting the material to use for the outer layer of the funerary item, casting and shaping the outer layer of the funerary item around the interior layer of the funerary item enclosing the decedent human or animal cremated remains, selecting the one or more mementos of the decedent, etching the one or more mementos on the outside of the outer layer of the funerary item.

* * * * *